US007993246B1

(12) United States Patent
Tillis

(10) Patent No.: US 7,993,246 B1
(45) Date of Patent: Aug. 9, 2011

(54) EXERCISING DEVICE

(76) Inventor: JeffRoy H. Tillis, Studio City, CA (US)

( * ) Notice: Subject to any disclaimer, the term of this patent is extended or adjusted under 35 U.S.C. 154(b) by 28 days.

(21) Appl. No.: 11/824,743

(22) Filed: Jul. 3, 2007

(51) Int. Cl.
*A63B 21/00* (2006.01)

(52) U.S. Cl. ..... 482/49; 482/44; 482/45; 482/97; 482/100

(58) Field of Classification Search ..... 482/99, 482/137, 100, 111, 49, 44, 97, 114, 113, 482/126, 135, 136
See application file for complete search history.

(56) References Cited

U.S. PATENT DOCUMENTS

| | | | | | |
|---|---|---|---|---|---|
| 4,795,149 | A * | 1/1989 | Pearson | 482/98 |
| 5,062,633 | A * | 11/1991 | Engel et al. | 482/118 |
| 5,224,912 | A * | 7/1993 | Moody | 482/87 |
| 5,413,546 | A * | 5/1995 | Basile | 482/99 |
| 5,669,859 | A * | 9/1997 | Liggett et al. | 482/94 |
| 5,897,466 | A * | 4/1999 | Capach | 482/83 |
| 6,004,247 | A | 12/1999 | Webber | |
| 6,113,522 | A * | 9/2000 | Fontenot et al. | 482/111 |
| 6,244,991 | B1 * | 6/2001 | Bingham | 482/69 |
| 6,394,937 | B1 | 5/2002 | Voris | |
| 7,094,185 | B2 | 8/2006 | Greenland | |
| 7,608,028 | B2 | 10/2009 | Pertegaz-Esteban | |
| 2002/0119871 | A1 | 8/2002 | Fulks | |
| 2002/0187882 | A1 | 12/2002 | Morris | |
| 2003/0022767 | A1 | 1/2003 | Webber | |
| 2004/0162194 | A1 | 8/2004 | Habing | |
| 2007/0093364 | A1 | 4/2007 | Batca | |

* cited by examiner

*Primary Examiner* — Jerome W Donnelly
(74) *Attorney, Agent, or Firm* — Scott R. Hansen; Fulwider Patton LLP

(57) ABSTRACT

An improved exercising machine comprising a framework, support members carried by the framework, a pair of guide assemblies with at least two degrees of freedom mounted on a respective support member for movement of the respective guide assembly, a pressure bar or handle moveably connected to a guide assembly, at least one resistive means connected to the framework, force transfer means providing connection between the respective guide assemblies and the resistive means, and dampening means to dampen the movement of the respective guide assembly slidable members which serve to prevent sudden and erratic movements of the guide assembly slidable members.

22 Claims, 8 Drawing Sheets

EXERCISING DEVICE

BACKGROUND

1. Field of Invention

This invention relates to exercising devices and is particularly directed to an improved exercising device comprising an exercising machine which simulates free-weight exercising.

2. Prior Art

In the exercising art, it is standard practice to stress respective muscles by pulling or pushing against a resistance means which can be adjusted to individual needs and abilities, to develop and improve the strength and tone of the respective muscles. Originally, this resistance force had been provided by so-called "free weights", consisting of barbells and dumbbells, used in various forms of exercise involving different techniques of pushing, pulling or lifting such weights to develop the respective muscles. The amount of the resistance force is varied to suit individual needs and abilities by adding or subtracting additional weights. Bench pressing and curling are typical examples of exercise, which involve pulling or pushing of barbells or dumbbells which could weigh from 5 to 800 pounds or more. These involve a considerable amount of space to enable a person to manipulate the weights without endangering other persons or furniture nearby. Also, time, effort and potential injury may result from adding or subtracting weight plates to the barbell or dumbbell bars and it is necessary to have a workout partner to insure the safety of the exerciser while performing common exercises, such as bench press and squat. In recent years, exercising machines have been developed as an answer to the problems of free weight exercise. Thus, various types of exercise machines have been developed which substitute other types of resistance means, such as springs, hydraulic or pneumatic cylinders and the like, as well as free weights. Although the previously mentioned problems of free weight exercise were solved to a very large extent by exercise machinery, subsequent studies in bio-mechanics determined drawbacks concerning the three types of force transfer found in exercise machinery—namely, cable transfer, lever transfer and linear transfer systems. Regarding cable transfer systems, it was determined that force vector dynamics created in a free weight environment were eliminated. These dynamics experienced bio-mechanically result in; the stimulating and activation of the contributor muscles, which aid the primary muscle groups involved by balancing and maintaining the pattern and integrity of the exercise movement; the stimulation and activation of the proprioceptors, which act as strain gauges in the body; and the promotion of the natural bio-mechanics of the body, which is to translate rotary movement into a linear result in an undefined environment.

Regarding lever transfer and linear transfer systems, as is the case with cable transfer systems, it was determined that force vector dynamics created in a free weight environment were also eliminated. Compounding this problem are the findings that lever transfer and linear transfer systems can create a substantial degree of injurious stress levels to ligaments, joints, tendons and muscles by virtue of movement occurring along an unnatural defined path. The body is forced to move in an unnatural motion, which is the source of previously mentioned stress to the body. Thus, none of the prior art exercise machines have been entirely satisfactory.

BRIEF SUMMARY AND OBJECTS OF INVENTION

These disadvantages of prior art exercising machines are overcome with the present invention and an improved exercise machine is provided which can, through various configurations, replicate substantially most fundamental types of "free weight" exercise and which is readily adaptable to use substantially any resistive means, yet which is relatively compact and simple to construct, install and operate and is inexpensive to purchase.

These advantages of the present invention are preferably attained by providing an improved exercise machine comprising a framework, support members carried by the framework, a pair of guide assemblies with at least two degrees of freedom mounted on a respective support member for movement of the respective guide assembly, a pressure bar or handle moveably connected to a guide assembly, at least one resistive means connected to the framework, force transfer means providing connection between the respective guide assemblies and the resistive means, and dampening means to dampen the movement of the respective guide assembly slidable members which serve to prevent sudden and erratic movements of the guide assembly slidable members.

Accordingly, it is an object of the present invention to provide an improved exercising machine.

Another object of the present invention is to provide an improved exercising machine which is adaptable to use substantially any type of resistive device.

An additional object of the present invention is to provide an improved exercising machine which can replicate substantially fundamental types of free weight exercise.

A further object of the present invention is to provide an improved exercising machine which is relatively compact and simple to construct, install and operate and is inexpensive to purchase.

A specific object of the present invention is to provide an improved exercise machine comprising a framework, support members carried by the framework, a pair of guide assemblies with at least two degrees of freedom mounted on a respective support member for movement of the respective guide assembly, a pressure bar or handle moveably connected to a guide assembly, at least one resistive means connected to the framework, force transfer means providing connection between the respective guide assemblies and the resistive means, and dampening means to dampen the movement of the respective guide assembly slidable members which serve to prevent sudden and erratic movements of the guide assembly slidable members.

These and other objects and features of the present invention will be apparent from the following detailed description, taken with reference to the figures of the accompanying drawings.

DETAILED DESCRIPTION OF THE INVENTION

Figure 1:
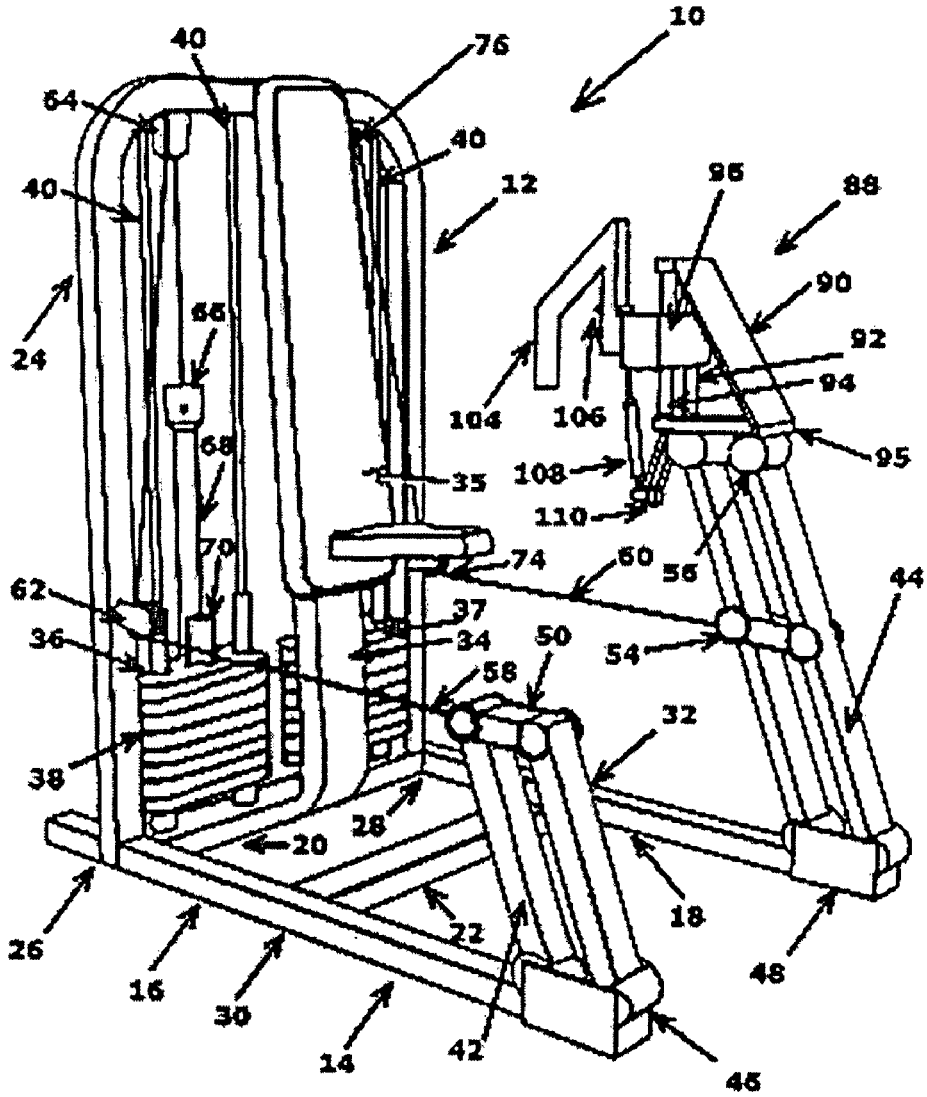
FIG. 1 is an angled front view of an exercising machine embodying the present invention.
Figure 2:
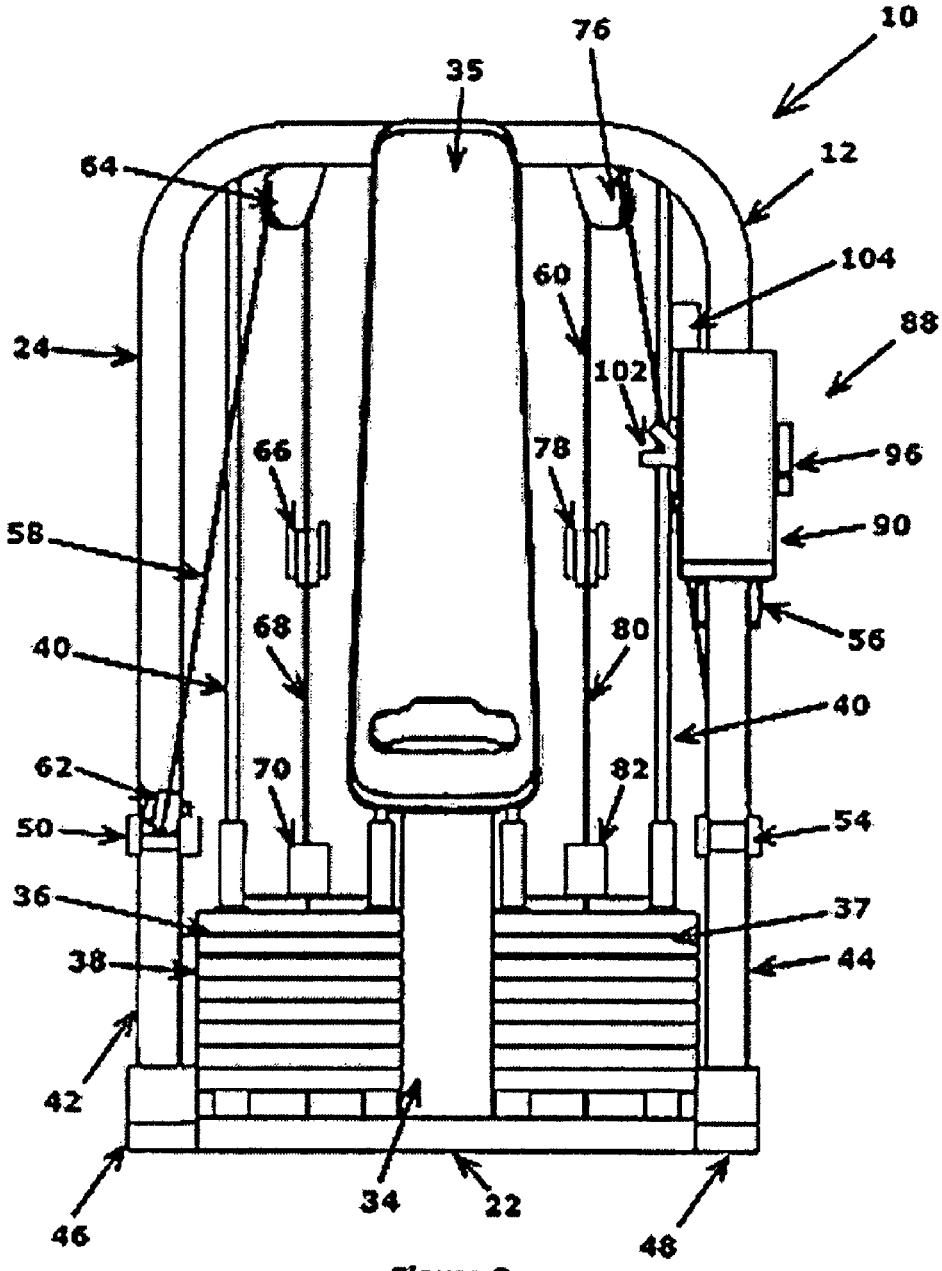
FIG. 2 is a front view of the exercising machine of FIG. 1.
Figure 3:
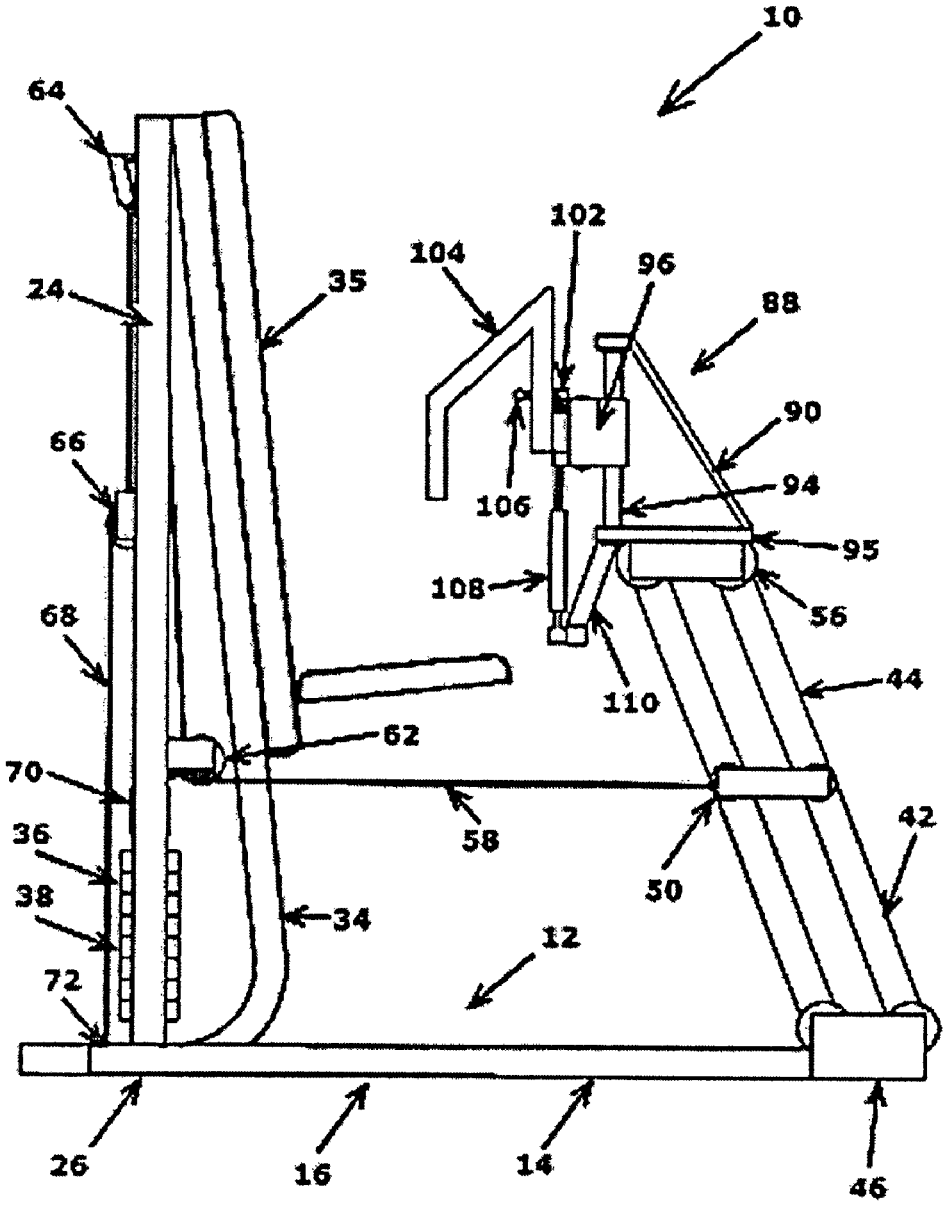
FIG. 3 is a left side view of the exercising machine of FIG. 1.
Figure 4:
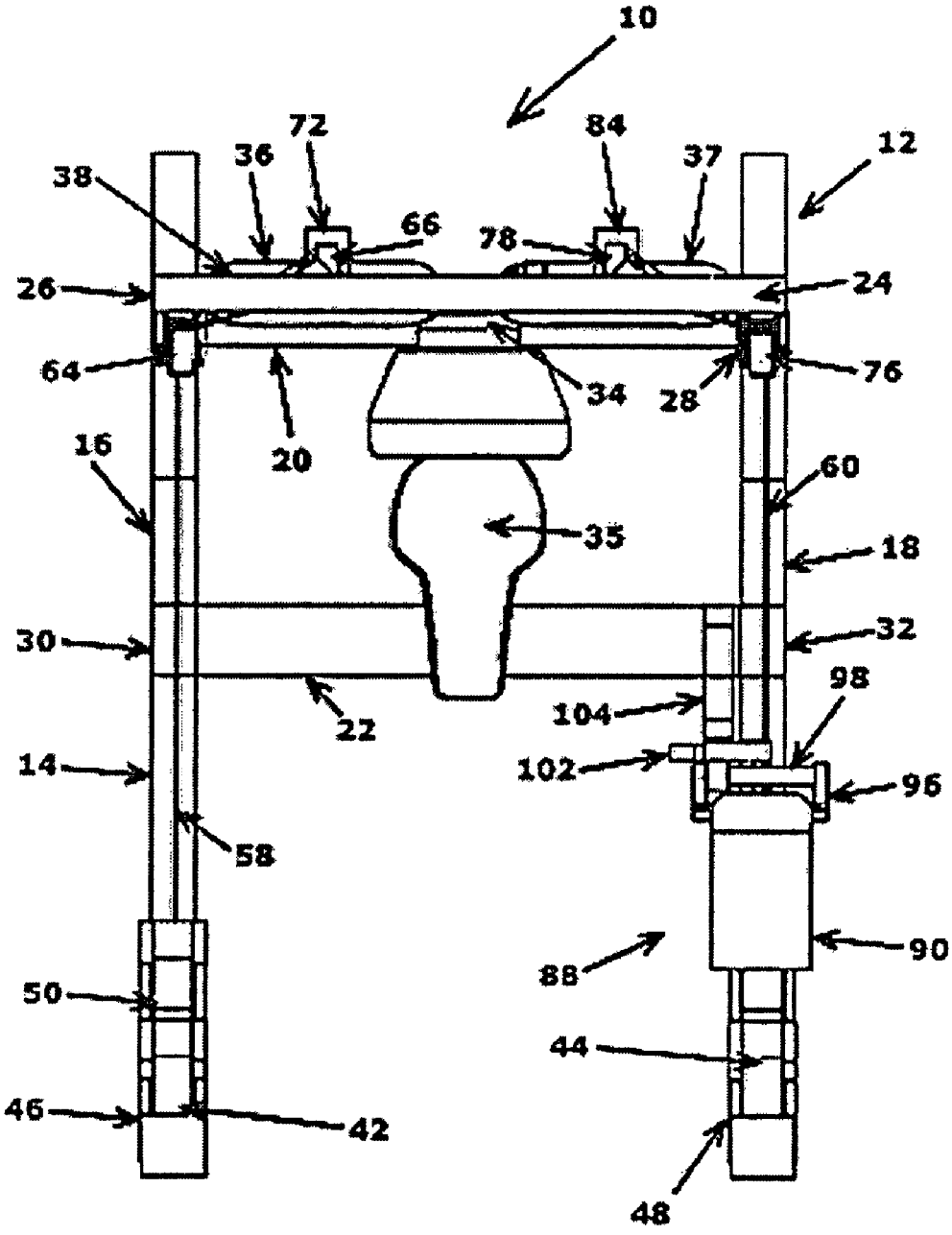
FIG. 4 is a top view of the exercising machine of FIG. 1.
Figure 5:
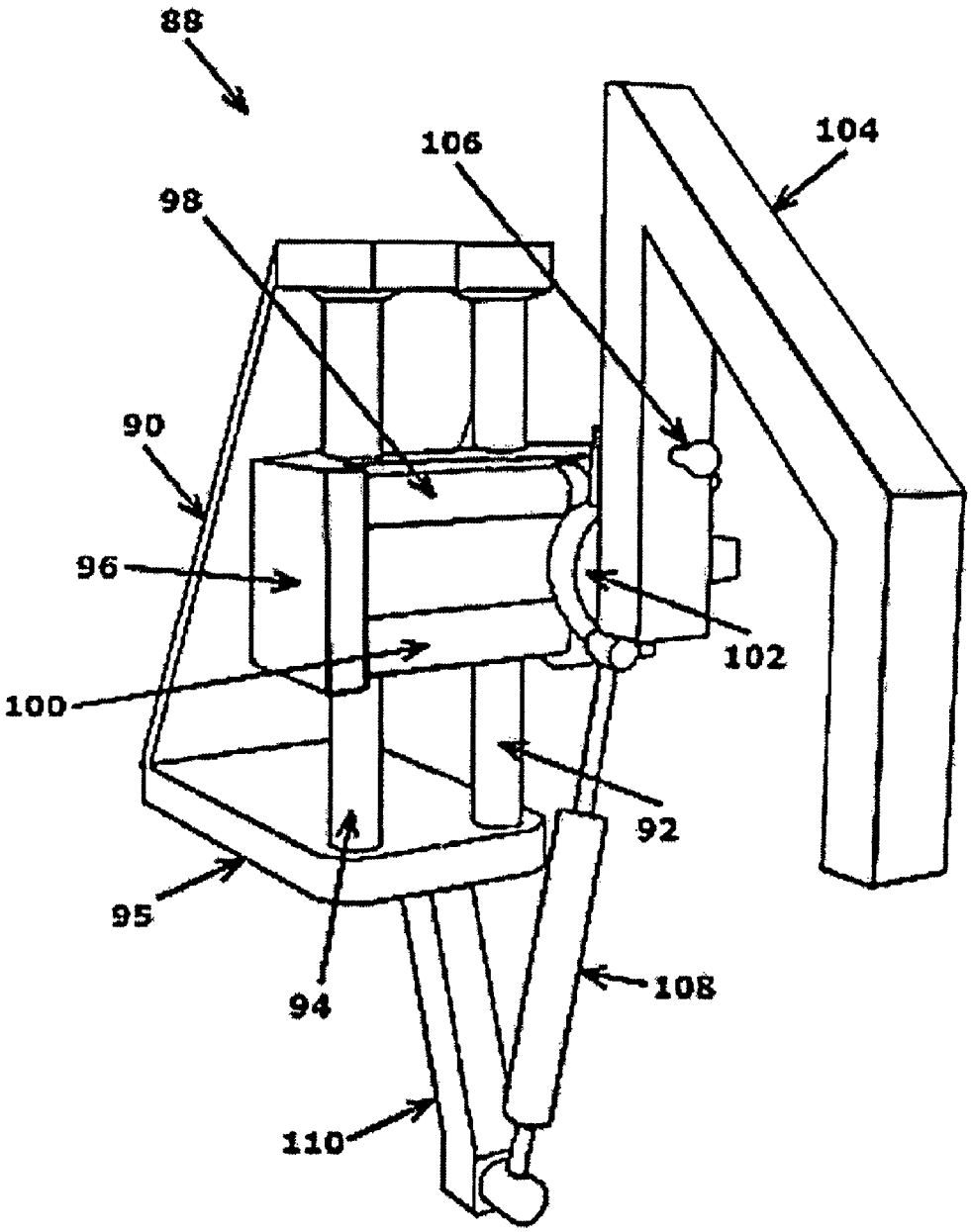
FIG. 5 is an angled front view of the guide assembly of FIG. 1.
Figure 6:
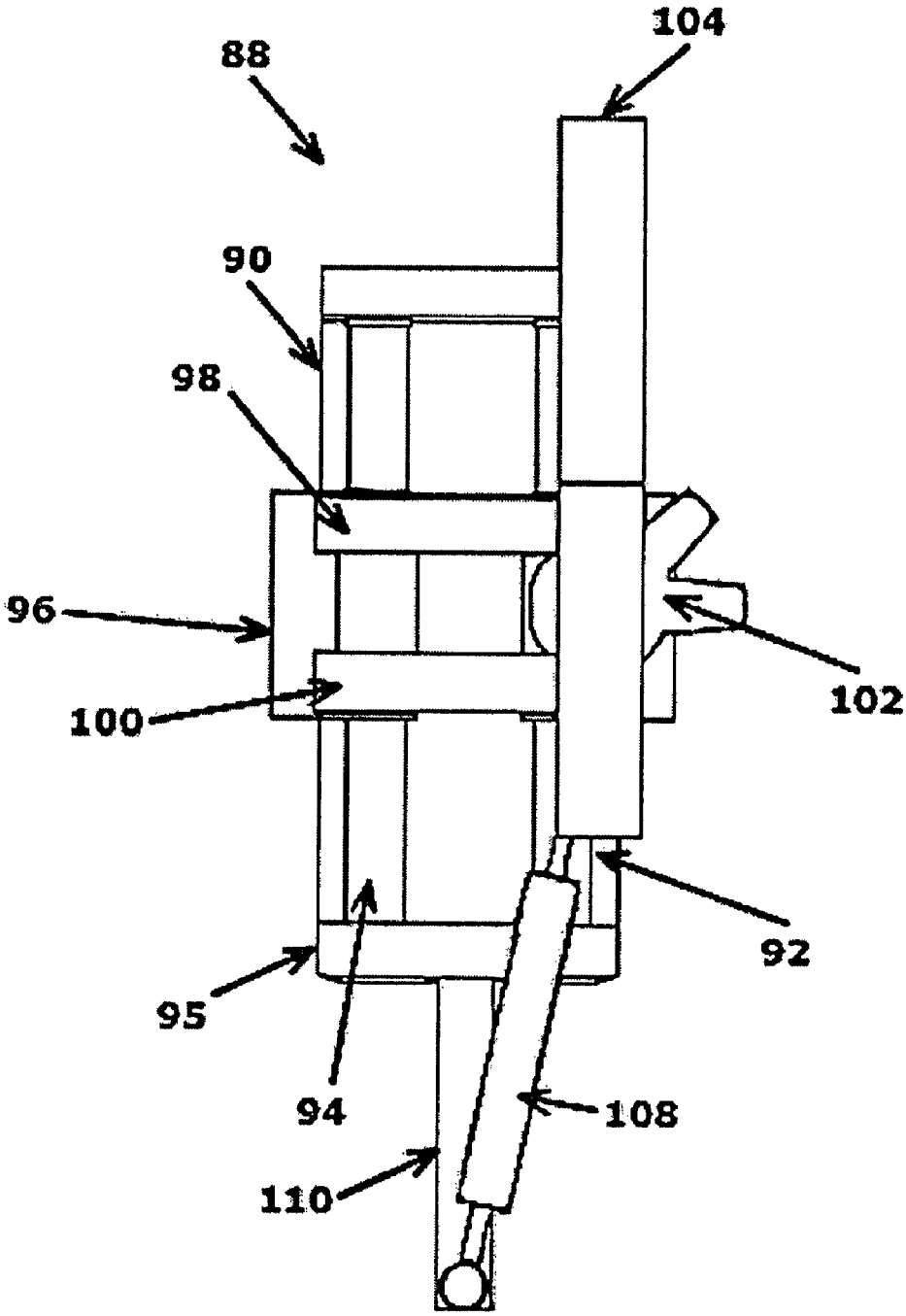
FIG. 6 is a front view of the guide assembly of FIG. 1.
Figure 7:
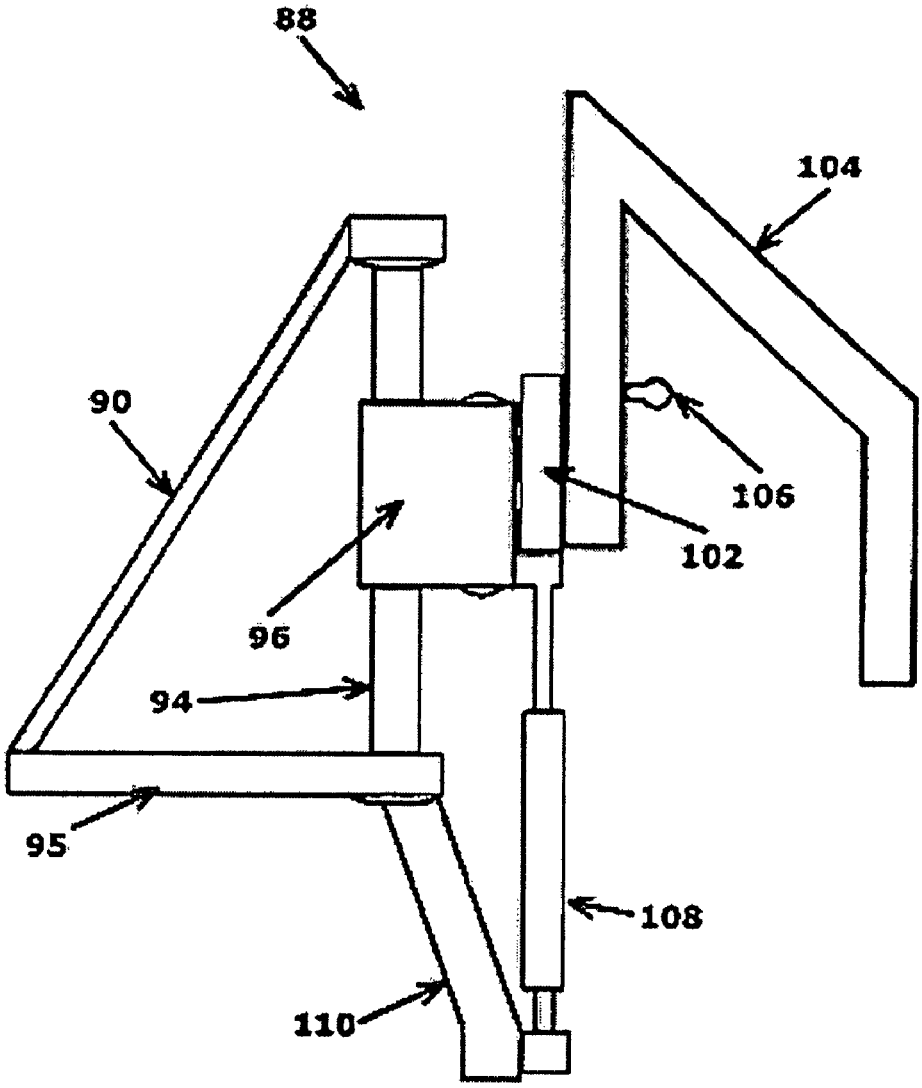
FIG. 7 is a left side view of the guide assembly of FIG. 1.
Figure 8:
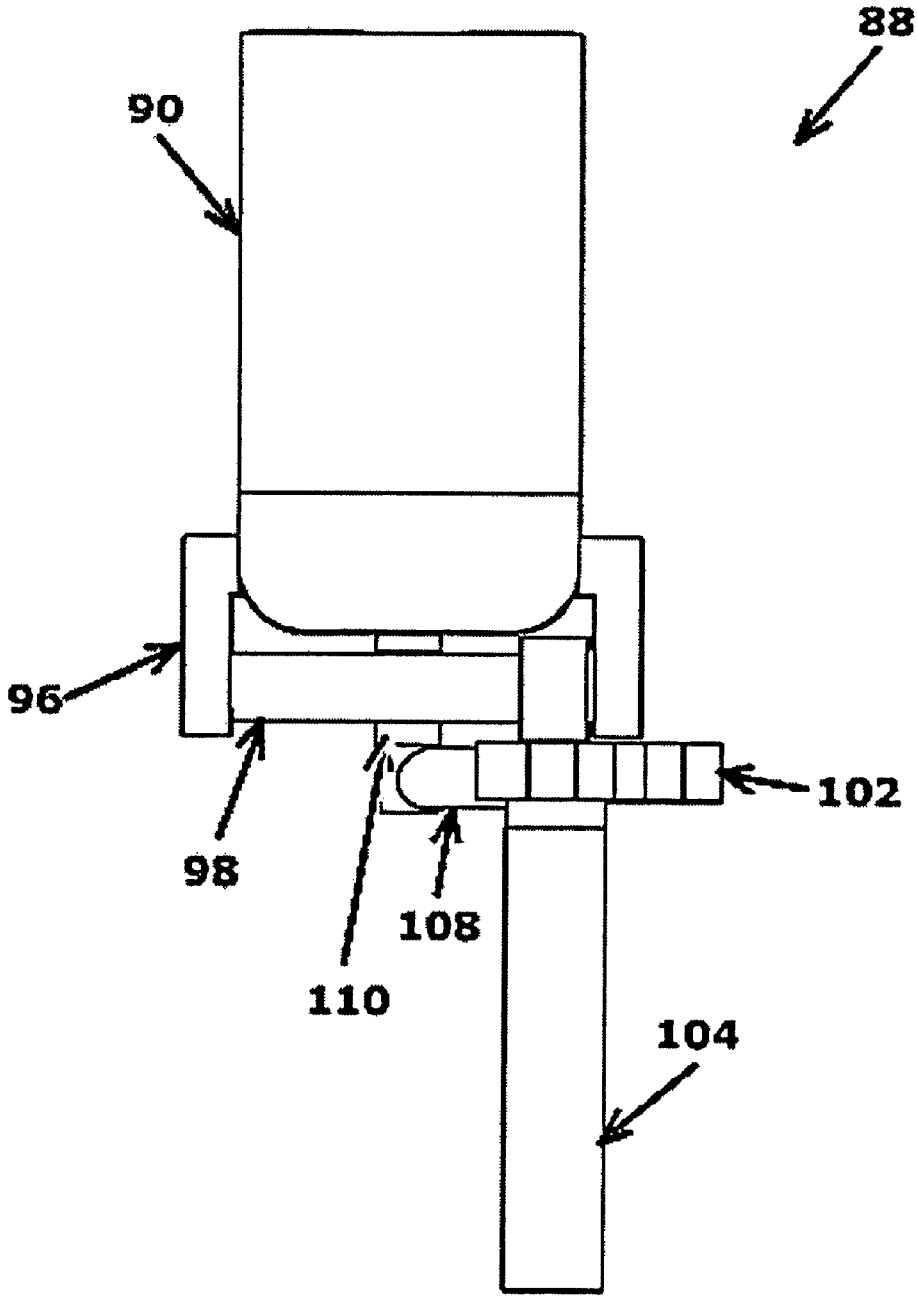
FIG. 8 is a top view of the guide assembly of FIG. 1.

In that form of the present invention chosen for purposes of illustration in the drawing, FIG. 1 shows an exercising machine, indicated generally at 10, comprising a generally supportive framework 12 having a base 14 comprising a pair of frame members 16 and 18 running front to rear of exercise machine 10 and a transverse support member 20 connected to frame members 16 and 18 at the rear section 26 and 28 respectively and a transverse support member 22 connected to frame members 16 and 18 at the middle section 30 and 32 respectively with a generally U-shaped frame member 24 rising vertically from the rear section 26 and 28 of frame members 16 and 18 respectively, and a back support member 34 connected to middle of transverse support member 20 and connected to the middle top of U-shaped frame member 24 with a exercise chair 35 connected to back support member 34. A pair of standard weight stacks 36 and 37 comprising of weight plates 38 acts as the resistance means for exercise machine 10 and are slideably mounted on guide bars 40 connected to transverse support member 20 and to the top of U-shaped frame member 24. Two support member pairs 42 and 44 pivot in forward and backward directions in relation to exercise machine 10 and are pivotally mounted onto support base members 46 and 48 connected to the front end of frame members 16 and 18 respectively and are reinforced by support connectors 50 and 52, and support connectors 54 and 56 of each respective member of support member pairs 42 and 44 allowing for parallel pivoting motion. Please note support member pair 42 is represented as being cut in half to allow for an unobstructed view of various components of exercise machine 10. Cable 58 is attached to support connector 50 and extends around pulley wheel 62 connected to frame member 24, then upward to and around pulley wheel 64 connected to frame member 24, then downward and being connected to pulley wheel 66. Cable 68 is connected at one end to weight stack connector rod 70 of weight stack 36 and extends around pulley wheel 66 and downward to frame connector 72. Cable 60 is attached to support connector 54 and extends around pulley wheel 74 connected to frame member 24, then upward to and around pulley wheel 76 connected to frame member 24, then downward and being connected to pulley wheel 78. Cable 80 is connected at one end to weight stack connector rod 82 of weight stack 37 and extends around pulley wheel 78 and downward to frame connector 84. A pair of guide assemblies 86 and 88 are mounted on support members 52 and 56 respectively and are more fully described hereinafter. Guide assembly 88 is comprised of slide mount member 90 consisting of two slide bars 92 and 94 mounted on slide bar support member 95, a main slide member 96 slidably mounted on slide bars 92 and 94 of slide mount member 90 and mounting two slide bars 98 and 100, a pressure mount 102 slidably mounted on slide bars 98 and 100, a handle 104 rotationally and lockably mounted with lock key 106 on handle 104 inserting into pressure mount 102 allowing for locked vertical or horizontal disposition of handle 104, and a dampening means 108 connected to pressure mount 102 and dampener mount 110 connected to slide bar support member 95 of slide mount member 90. Guide assembly 112 is comprised of slide mount member 114 consisting of two slide bars 116 and 118 mounted on slide bar support member 119, a main slide member 120 slidably mounted on slide bars 116 and 118 of slide mount member 114 and mounting two slide bars 122 and 124, a pressure mount 126 slidably mounted on slide bars 122 and 124, a handle 128 rotationally and lockably mounted with lock key 130 on handle 128 inserting into pressure mount 126 allowing for locked vertical or horizontal disposition of handle 128, and a dampening means 132 connected to pressure mount 126 and dampener mount 134 connected to slide bar support member 119 of slide mount member 114.

Obviously, numerous variations and modifications may be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. An exercise machine to simulate a free weight experience to a user, comprising:

a exercise machine frame;

a first support member pivotally mounted to the exercise machine frame;

a slide bar support member supported by the support member;

at least one first slide bar extending in a first direction from the slide bar support member;

at least one slide member slidably mounted on the first slide bar, the slide member comprising at least one second slide bar extending in a second direction that is substantially perpendicular to the first direction;

a handle slidably mounted on the second slide bar;

wherein the handle is slidable in the first direction along the first slide bar, is slidable in the second direction across the second slide bar, and is moveable inwardly and outwardly relative to a user as the first support member pivots with respect to the exercise machine frame.

2. An exercise machine as defined in claim 1, wherein the handle is interconnected with a source of resistance.

3. An exercise machine as defined in claim 1, wherein the handle is mounted on a pressure mount which is in turn mounted on the first slide bar.

4. An exercise machine as defined in claim 1, wherein the handle is interconnected with a dampener.

5. An exercise machine as defined in claim 4, wherein the dampener is secured to a damper mount that supports the slide bar support member.

6. An exercise machine as defined in claim 1, wherein the exercise machine frame includes a substantially vertically-extending, generally U-shaped frame.

7. An exercise machine as defined in claim 6, wherein at least one weight-stack support bar is attached to the substantially vertically-extending, generally U-shaped frame, and a weight stack is supported by the weight-stack support bar.

8. An exercise machine as defined in claim 2, wherein the source of resistance is interconnected with the first support member.

9. An exercise machine as defined in claim 8, wherein the source of resistance comprises a wire attached to the first support member, the wire also being interconnected with a stack of weights.

10. An exercise machine as defined in claim 1, wherein the handle is further rotationally mounted with respect to the horizontal slide bar.

11. An exercise machine as defined in claim 10, wherein the handle comprises an assembly including a pressure mount, the pressure mount including a lock, the handle having a first mode in which the handle is locked into position and a second mode in which the lock is unlocked and the handle is free to rotate relative to the horizontal slide bar.

12. An exercise machine as defined in claim 1, wherein the handle is interconnected with a pressure mount, the pressure mount being mounted on the second slide bar.

13. An exercise machine to simulate a free weight experience to a user, comprising:

a base frame;

a first support member pivotally mounted on the base frame;

a slide bar support member supported by the support member;

at least one slide bar extending substantially vertically from the slide bar support member;

at least one slide member slidably mounted on the substantially vertical slide bar, the slide member comprising at least one substantially horizontal slide bar;

a handle slidably mounted on the substantially horizontal slide bar;

wherein:

the handle is slidable vertically along the at least one substantially vertical slide bar support member, is slidable horizontally across the at least one substantially horizontal slide bar, and is moveable inwardly and outwardly relative to a user as the first support member pivots with respect to the base frame;

the first support member is interconnected with source of resistance;

the handle is mounted to a dampener; and the handle is further rotationally mounted with respect to the horizontal slide bar.

14. An exercise machine as defined in claim 13, wherein the handle comprises a lock, the handle having a first mode in which the handle is locked into position and a second mode in which the lock is unlocked and the handle is free to rotate relative to the horizontal slide bar.

15. An exercise machine as defined in claim 13, wherein the source of resistance is weights.

16. An exercise machine as defined in claim 13, wherein the dampener is secured to a damper mount that supports the slide bar support member.

17. An exercise machine as defined in claim 13, wherein the base frame is substantially horizontal and is interconnected with a substantially vertically-extending, generally U-shaped frame.

18. An exercise machine as defined in claim 17, wherein at least one weight-stack support bar is attached to the substantially vertically-extending, generally U-shaped frame, and a weight stack is supported by the weight-stack support bar.

19. An exercise machine to simulate a free weight experience to a user, comprising:

a base frame;

a first support member pivotally mounted on the base frame;

a slide bar support member supported by the support member;

at least one slide bar extending substantially vertically from the slide bar support member;

at least one slide member slidably mounted on the substantially vertical slide bar, the slide member comprising at least one substantially horizontal slide bar;

a handle slidably mounted on the substantially horizontal slide bar;

wherein:

the handle is slidable vertically along the at least one substantially vertical slide bar support member, is slidable horizontally across the at least one substantially horizontal slide bar, and is moveable inwardly and outwardly relative to a user as the first support member pivots with respect to the base frame;

the first support member is interconnected with source of resistance;

the handle is mounted to a dampener;

the handle is further rotationally mounted with respect to the horizontal slide bar;

the handle is part of a handle assembly comprising a lock, the handle having a first mode in which the handle is locked into position and a second mode in which the lock is unlocked and the handle is rotatable relative to the horizontal slide bar;

the dampener is secured to a damper mount that supports the slide bar support member; and the base frame is substantially horizontal and is interconnected with a substantially vertically-extending, generally U-shaped frame.

20. An exercise machine as defined in claim 19, wherein at least one weight-stack support bar is attached to the substantially vertically-extending, generally U-shaped frame, and a weight stack is supported by the weight-stack support bar.

21. An exercise machine to simulate a free weight experience to a user, comprising:

a base frame;

a first support member extending from the base frame;

a slide bar support member mounted on the support member;

at least one first slide bar extending in a first direction from the slide bar support member;

at least one slide member slidably mounted on the first slide bar, the slide member comprising at least one second slide bar extending generally perpendicularly to said first slide bar;

a handle slidably mounted on the second slide bar;

wherein the handle is slidable in a first direction along the first slide bar, is slidable in a second direction generally perpendicular to said first direction across the second slide bar, and is moveable inwardly and outwardly relative to a user.

22. An exercise machine as defined in claim 21 wherein the handle comprises a bar.

* * * * *